United States Patent [19]

Yamamoto et al.

[11] 4,174,170

[45] Nov. 13, 1979

[54] CONDUCTIVE TONER TRANSFER PHOTOCOPYING MACHINE

[75] Inventors: Toshio Yamamoto; Shizuo Yuge, both of Toyokawa, Japan

[73] Assignee: Minolta Camera Kabushiki Kaisha, Osaka, Japan

[21] Appl. No.: 861,005

[22] Filed: Dec. 15, 1977

[30] Foreign Application Priority Data

Dec. 16, 1976 [JP] Japan ..... 51-151677

[51] Int. Cl.[2] ..... H01T 19/04; G03G 15/00

[52] U.S. Cl. ..... 355/3 TR; 250/325; 355/3 CH; 361/229

[58] Field of Search ..... 355/3 R, 3 CH, 3 TR, 355/3 TE, 3 SH; 361/229, 230; 250/324, 325, 326

[56] References Cited

U.S. PATENT DOCUMENTS

| | | | |
|---|---|---|---|
| 3,303,401 | 2/1967 | Naumann et al. | 361/229 |
| 3,483,372 | 12/1969 | Benson | 361/230 X |
| 3,611,074 | 10/1971 | Weichardt | 361/229 |
| 3,620,617 | 11/1971 | Kelly et al. | 355/3 TR |
| 3,660,656 | 5/1972 | Frank et al. | 361/229 X |
| 3,811,048 | 5/1974 | Matsumoto et al. | 361/230 X |
| 3,936,175 | 2/1976 | Jones | 355/3 TR |
| 3,986,189 | 10/1976 | Van Biesen et al. | 361/230 X |
| 4,053,769 | 10/1977 | Nishikawa et al. | 250/324 |
| 4,087,168 | 5/1978 | Fraser | 355/3 R X |

*Primary Examiner*—Fred L. Braun

*Attorney, Agent, or Firm*—Wenderoth, Lind & Ponack

[57] ABSTRACT

Photocopying machine comprising shield elements which are provided between an electrophotosensitive medium and a corona discharge unit at a transfer station, define a slit to permit transfer of conductive toner particles onto copy paper charged by the corona discharge unit but prevent imposition on the paper of a charge liable to cause early transfer of toner particles or of a charge liable to cause cancellation of the charge of the toner particles, and hence detachment, of toner particles on the copy paper.

8 Claims, 13 Drawing Figures

CONDUCTIVE TONER TRANSFER PHOTOCOPYING MACHINE

The present invention relates to a photocopying machine wherein development of a latent image on an electrophotosensitive medium is effected by powder material, which is subsequently transferred onto copy paper, or other support means. More particularly, the invention relates to a photocopying machine in which is employed toner development material of the so-called one-component or conductive type, but which avoids problems of blurring or lack of density conventionally associated with such toner material.

According to a commonly employed photocopying process, by the electrically charged outer layer portion of an electrophotosensitive medium, which for reasons of compactness of a photocopying machine is most suitably in the form of a rotatable drum is exposed to image-wise light reflected from an original document to be copied, whereby a latent image of the document is formed in the outer layer of the medium and then the latent image is developed by applying toner, i.e., fluid developer material in the form of finely divided powder, onto the image-carrying portion of the electrophotosensitive medium by magnetic brush, cascade, or similar known process, the toner being electrically charged at a polarity opposite to that of image-defining portions of the electrophotosensitive medium, and therefore adhering the medium in a pattern corresponding to the content of the original document. The developed image is subsequently brought into effective contact with a sheet of copy paper or similar support at a transfer station whereat there is provided a corona discharge unit which charges the rear surface of the copy paper, to a potential of the same polarity as but of greater value than the potential on the image-defining portions of the electrophotosensitive medium, whereby toner particles are transferred from the medium onto the copy paper. In this transfer process it is most common practice to cause surface portions of the electrophotosensitive medium and copy paper to move at the same speed in the same general direction and effect transfer of successive portions of a developed image onto successive portions. After transfer of the image-defining particles onto the copy paper, the copy paper is suitably passed through a fixing station whereat the toner particles are fixed to the copy paper, by being heated and fused thereon, for example.

The toner material employed may be of the so-called two-component type which consists of toner, constituted by a dielectric synthetic resin, numerous examples of which are given in the prior arts and carriers, for instance made of magnetic particles, which are agitated together with the toner, thereby producing a triboelectric effect by which the toner particles may be subsequently held to the surface of the electrophotosensitive drum, to develop a latent image, ready for transfer onto copy paper at a transfer station.

Conventionally, a corona discharge unit at the transfer station has the construction shown schematically in FIG. 1, in which a corona wire 2' connected to a suitable power source, not shown, and extending parallel to and having a length generally equal to the width of an image carried by rotating electrophotosensitive drum 6 is located within the area defined by a shield element 3', which is suitably grounded electrically and comprises side walls defining an opening of width W' facing the electrophotosensitive medium. The corona discharge unit 1' is positioned so that a corona stream may be directed thereby onto the rear surface of successive portions of copy paper 5 brought to a transfer station, to cause transfer onto the copy paper 5 of image-defining toner particles from the drum 6.

Charge imposed on the copy paper 5 by the corona discharge unit 1' is stored on the rear of the copy paper 5, and to cause transfer of dielectric toner onto the copy paper 5 must be sufficiently high to overcome the electrostatic force of attraction holding the dielectric toner to the drum 6. In other words, transfer of dielectric toner does not commence until the charge stored by the copy paper 5 has built up to a requisitely high value, which requires a certain amount of time, t'. This time t' varies in dependence on various factors, but is generally at least $3\times10^2$ msec., and in a given set of conditions quality of photocopies varies depending on the length of time t'. To assess dependence of quality of photocopies of time t', the inventors conducted tests employing a photocopying machine in which opening width W' of the unit 1' was 25 mm, the distance a between the plane of the opening and the corona wire 2' was 5 mm, the distance b between the corona wire 2' and the surface of the electrophotosensitive drum 6 was 15 mm, drum 6 was charged to 1,000 V, and potential imposed on the corona wire 2' was such as to cause a load current to be applied on the rear of the copy paper 5. In the tests, speed of copy paper advance was varied, and quality of photocopies examined. Time t' was calculated by the approximate formula $$t' = \frac{\text{corona discharged width onto the rear surface of copy paper}}{\text{speed of copy paper advance}} \approx \frac{\text{width } W' \times b/a}{\text{speed of copy paper advance}}$$

The relation between photocopy quality and time t' is shown in Table 1.

Table 1

| | | | |
|---|---|---|---|
| Speed of copy paper advance | 100 | 200 | 300 (mm/sec) |
| Photocopy quality | good | slightly unsatisfactory | poor |
| Time t' | 750 | 375 | 250 (m sec) |

It is seen from Table 1 that with corona discharge unit dimensions and imposed voltages as noted above corona exposure time t' which is the time the copy paper is exposed to corona discharge unit must be of the order of $4\times10^2$ msec if good quality photocopies are to be obtained. It is possible to make time t' smaller by changing position of the corona discharge unit, A' in general it is not possible to reduce time t' to below 300 msec.

Because of this duration of time t', with the construction shown in FIG. 1 there is inevitably spread of discharge produced by the unit 1', and in the case of this spread is large, dielectric toner on the drum 6 is influenced by the charges on the copy paper before they arrive at a position whereat transfer should take place. Therefore, as illustrated in FIG. 2, instead of being attracted to point A' on the copy paper 5 where it serves to define an image together with other toner particles, a toner particle may in fact be attracted to point B', which can result in reduction of density of the image area and blurring of other portions of the copy paper. This is a particular problem in smaller photocopying machines employing an electrophotosensitive drum having a small diameter.

Prevention of such incorrect transfer may be partially achieved by insulating flap means such as disclosed in U.S. Pat. No. 3,620,617, which covers a portion of the opening of the corona discharge unit, although such prevention is not a specific object of the disclosed means. U.S. Pat. No. 3,850,519, however, discloses a means which is completely effective in preventing such incorrect transfer of toner particles and consists basically of a baffle means which is provided between a corona discharge unit and portions of copy paper which are about to arrive at a transfer station. The cited patent does not, however, disclose dimensional requirements of such a baffle means in the line of copy paper, i.e., it is not disclosed to what extent copy paper should be shielded from the corona discharge or what resulting dimensions of the unshielded portion of the transfer station should be.

Even if the dielectric toner is transferred by such corona discharge unit provide with the baffle means, it is necessary that the dimension of such corona discharge unit guarantee the time to be larger than t' for the copy paper exposed to ionic current. Meanwhile the developing process which uses the so-called monocomponent toner is disclosed in U.S. Pat. No. 3,909,258. The toner employed in this process consists of magnetic particles which are so to speak 'encapsulated' in synthetic resin, to constitute fine conductive particles, and in the description below this type of toner will be referred to simply as conductive toner, and the abovedescribed two-component toner as dielectric toner. This conductive toner has function of being formed into the image and also the function to move by themselves the electrophotosensitive medium.

In a process using conductive toner, the toner particles are picked up as a brush like form by a conductive sleeve which contains a rotating magnet, and is sufficiently close to the drum 6 to be able to apply toner particles thereon. When toner particles are brought near the surface of the electrophotosensitive drum by the sleeve, the charges corresponding to the charges on the electrophotosensitive medium are induced in the conductive toner through the conductive sleeve and there are formed chains of toner particles extending between the sleeve and the drum, but only the portions of the drum 6 which define an electrostatic image have a charge sufficient to counter the attractive force of the magnet in the sleeve and cause toner particles to adhere thereto, and for other portions of the drum 6 the counter-attractive force of the magnet causes the toner particles to move back to the sleeve, whereby an electrostatic image may be developed by the toner particles. That is to say, this process achieves the development by difference of electrostatic attractive force which attracts the toner toward electrophotosensitive medium and magnetic attractive force which attracts the toner toward the sleeve. Also, tests conducted by the inventors showed that use of conductive toner results in very efficient development of images. However, in the transfer process there is a problem of so-called blow-off, which is described in reference to FIG. 3. A conductive toner particle T is transferred to copy paper 5 at a time $t_1$, which is short compared with time t' required for effecting transfer of dielectric toner, but at time $t_2$ the particle T is attracted back to the drum 6, resulting in reduced density and definition in a completed photocopy. The reason for blow-off of toner particles is thought to be as follows.

Between time $t_0$ and time $t_1$ as indicated in FIG. 3 there is stored on the rear of the copy paper 5 a charge equal to that of the electrostatic image on the drum 6.

At time $t_1$ the value of charge stored on the rear of the copy paper 5 becomes great enough to attract toner particles to the front surface of the copy paper 5. As noted earlier, this charge is not required to be great, and $t_1$ is shorter than the time t' required to effect transfer of dielectric toner particles.

Between time $t_0$ and $t_2$ charge gradually moves through the copy paper 5 and at time $t_2$ cancels the charge on toner particles, which, since their polarity is in effect reversed, react against the charge of the copy paper 5 and fly back to the electrophotosensitive drum.

Thus, when conductive toner is employed for transfer by conventional transfer station means there is liable to be reduced density and definition of photocopies.

It is accordingly a principal object of the present invention to provide a photocopying machine wherein problems both of incorrect early transfer and of blow-off of conductive toner at a transfer station are eliminated.

It is a further object of the invention to provide a photocopying machine having a transfer station of specified dimensions and construction to permit production of photocopies of having good definition and density while avoiding the abovenoted problems of incorrect transfer and blow-off.

In accomplishing these and other objects, there is provided, according to the present invention, a photocopying machine wherein the opening of a corona discharge unit at a transfer station is provided with shield elements which extend over entry and exit portions thereof, i.e., portions thereof with which copy paper being moved through the transfer station first comes into line and last comes into line. The entry side shield serves to prevent incorrect early transfer and the exit side shield to prevent blow-off toner particles, the shield being suitably made of dielectric material for improved effectiveness. The clearance defined between the shields in effect constitutes the corona discharge unit opening, and the inventors conducted series of tests to determine requisite dimensions of this clearance in order to ensure efficient shielding action and at the same time good quality of photocopies, and it was found that there was liable to be reduced photocopy quality in terms of density when the clearance between the shields was small, but that this can easily be compensated by increasing potential applied on the corona discharge wire, such increase of applied voltage presenting no problems in production of photocopies with conductive toner, since required corona discharge unit voltage is initially low.

A better understanding of the present invention may be had from the following full description thereof when read in reference to the attached drawings in which like numbers refer to like parts, and FIG. 1 is a schematic view of transfer station means of a conventional photocopying machine;

Figure 8A:
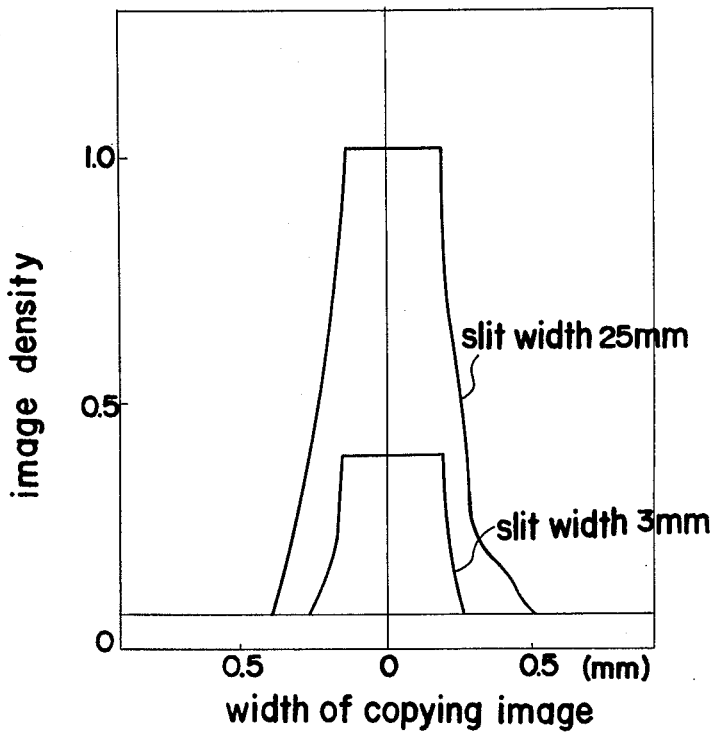
Figure 8B:
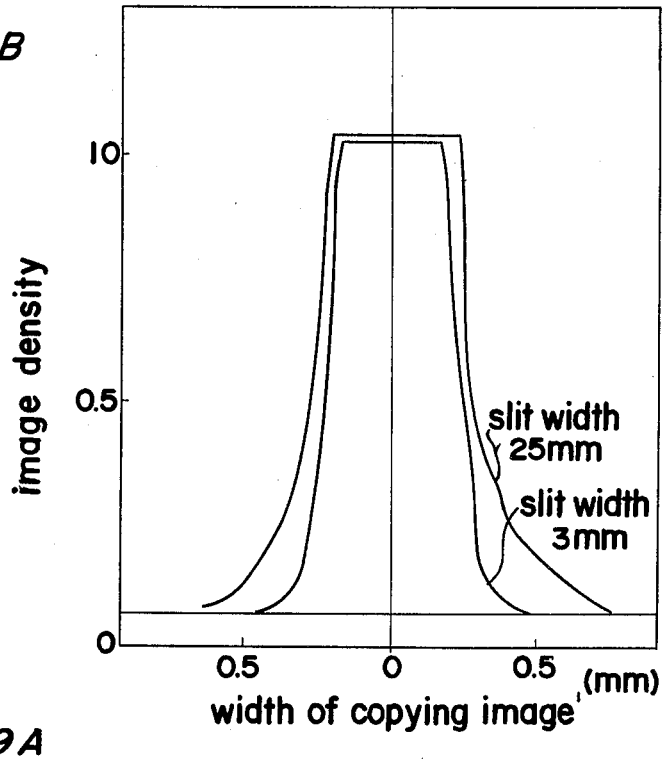
Figure 9A:
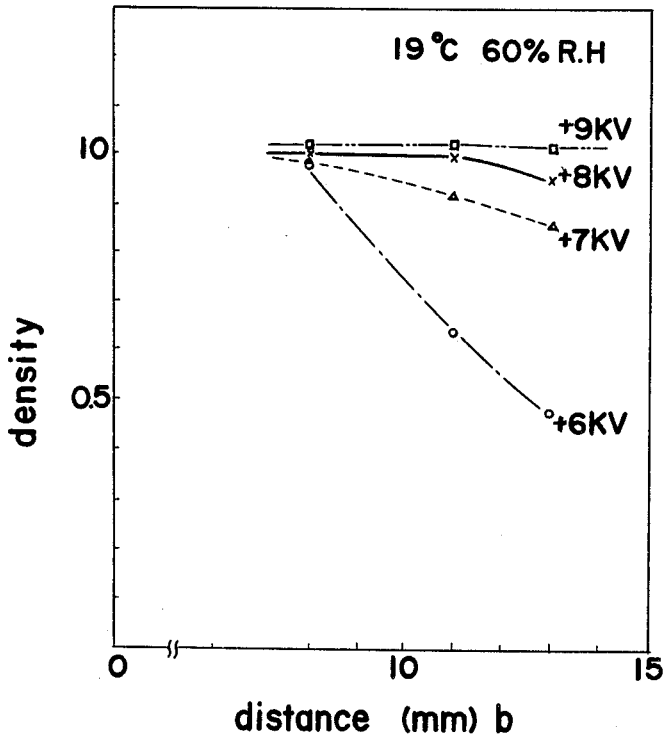
Figure 9B:
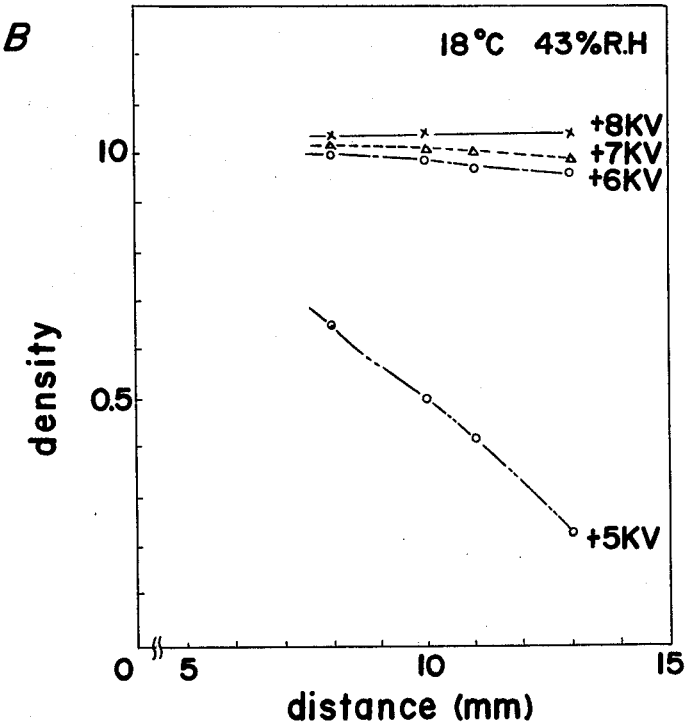
Figure 9C:
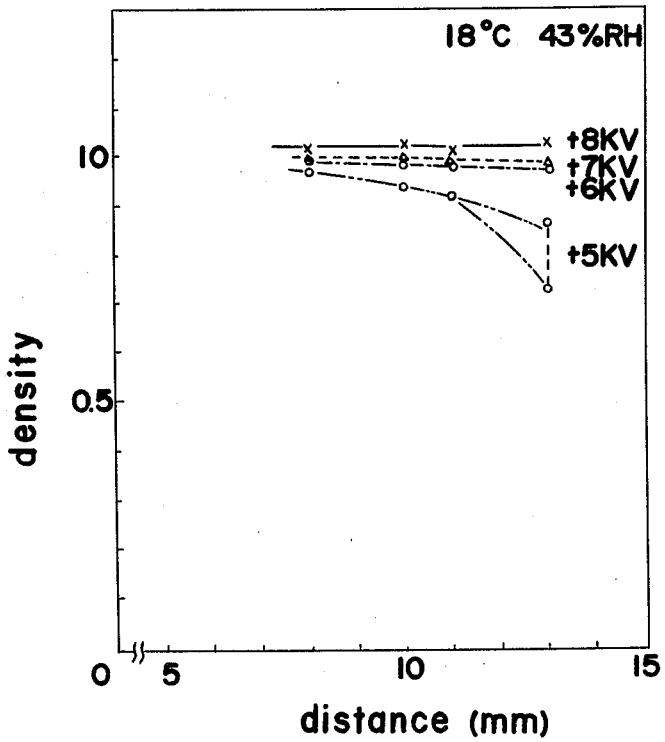

FIGS. 8A and 8B are graphs showing relationship between width of opening of a corona discharge unit and density of photocopies of line drawings at a given charging voltage; and FIGS. 9A, 9B and 9C are graphs showing the relation between image density of a completed photocopy and distance of a corona discharge unit from an electrophotosensitive medium for different values of voltage applied on the corona discharge unit and a set width of corona discharge unit opening.

Figure 4:
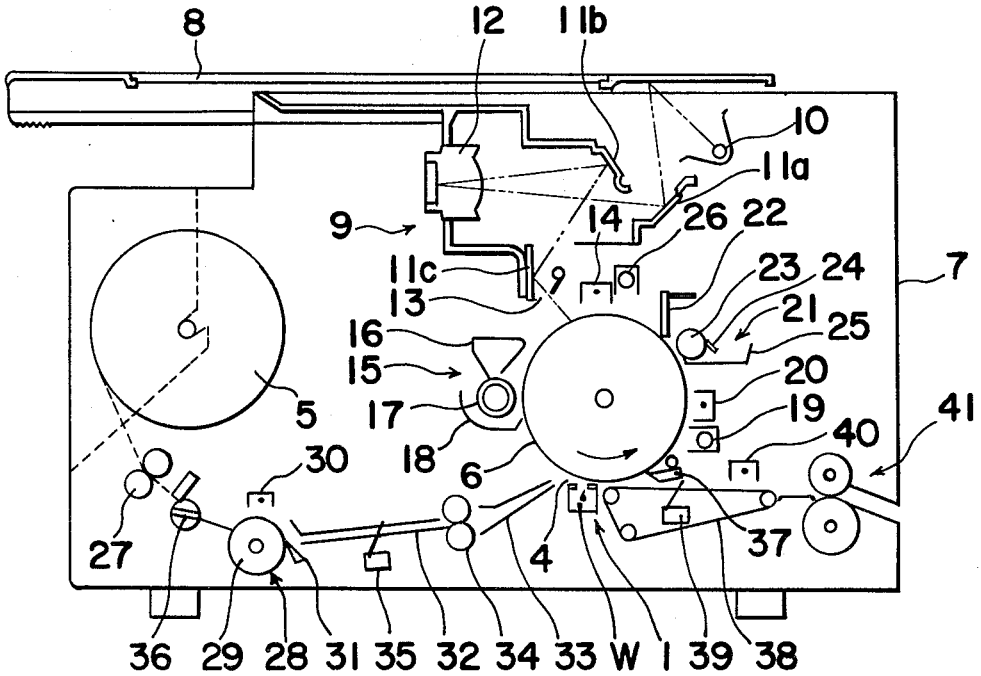
FIG. 4 is a schematic cross-sectional view showing main elements of a photocopying machine according to one embodiment of the invention.

Referring to FIG. 4, there is shown a photocopying machine comprising a main body 7 on the upper wall portion of which there is provided a transparent document rest 8 which is movable by known means not shown, to permit successive portions of a document supported thereon to be brought, in a scanning process, to an exposure station which is above an optical system 9. The optical system 9 comprises a lamp 10 which illuminates document portions brought to the exposure station. Image-wise light is reflected downwards from illuminated document portions and then directed by a system including mirrors 11*a*, reflective focussing lens 12, mirror 11*b*, and mirror 11*c* onto the surface of electrophotosensitive drum 6 which is rotated counterclockwise as seen in the drawing, whereby successive portions of the drum 6 which have previously been charged by a charging unit 14 are exposed to image-wise light from and form an electrostatic latent image of successive portions of the scanned original document on the support 8. The ratio of peripheral speed of the drum 6 to the linear speed of scanning of the original document on the support 8 is selected with reference to the degree of magnification required to be achieved in a completed photocopy, and is suitably 1 for a magnification of 1. As the drum 6 continues to rotate the image-carrying portions thereof are brought to a development station 15 comprising a supply hopper 16 from which conductive toner is supplied into a receptacle 18 from which the particles are picked up by a rotary sleeve 17 which suitably has a construction such as disclosed in U.S. Pat. No. 3,909,258, contains a permanent magnet, and has an outer surface which in effect defines a magnetic brush and serves to carry toner particles onto the surface of the drum 6. The toner particles, which suitably has a resistivity of $10^3$ to $10^7$ Ωm when subjected to compressive pressure of 100 kg/cm$^2$, adheres to the surface of the drum 6 in a pattern corresponding to the latent image which is carried by the drum 6 and which therefore becomes visible.

The developed image is then brought to a transfer station whereat there is provided a corona discharge unit 1 having a construction described in greater detail below, and whereat successive portions of the image-carrying portion of the drum 6 are brought into effective contact with a sheet of copy paper 5 which is moved past the transfer station at a linear speed equal to the peripheral speed of the drum 6, and the rear surface of which is charged by the corona discharge unit 1.

The copy paper 5 is provided initially in the form of a roll, shown in the left-hand portion of FIG. 4, from which it led by a pair of forwarding rolls 27, upon actuation of a photocopying machine start switch, for example. The rolls 27 move the copy paper 5 through a cutter unit 36, which is actuated a set time after start of actuation of the rolls 27 and cuts off a copy paper sheet of set size, which is then moved to a preheating unit 28 comprising a rotating heater drum 29, corona discharge unit 30 and stripper element or elements 31. The copy paper 5 is moved into contact with the periphery of the heater drum 29, and the action of the corona discharge unit 30 causes the copy paper 5 to be held to the drum 29 by the force of electrostatic attraction, whereby the copy paper 5 may be efficiently heated by the drum 29. The purpose of this pre-heating is to remove any moisture which may have been absorbed by the copy paper 5, since such moisture could otherwise cause incomplete transfer or smearing of toner particles in the subsequent transfer process, so resulting in a photocopy of poor quality. Humidity is particularly liable to have such adverse effects when conductive toner is employed. As the heater drum 29 rotates, the copy paper 5 is brought to and detached from the drum 29 by the stripper element 31, and is then moved through a guide element 32 and into engagement with forwarding rolls 34. As the copy paper 5 passes through the guide element 32, the leading end thereof actuates a microswitch 35, which causes actuation of the various elements associated with electrophotosensitive drum 6, and also causes document support 8 to be moved at a speed matching that of electrophotosensitive drum 6. The forwarding rolls 34 move the copy paper 5 through a guide 33, which guides the copy paper 5 through the abovementioned transfer station including corona discharge unit 1. After passing through the transfer station, the copy paper 5 moves onto conveyor belts 38, either directly or after being detached from the drum 6 by a stripper element or elements 37. The belt conveyors 38 move the copy paper 5 now carrying transferred toner particles into contact with a microswitch 39, which serves to stop the photocopying process after a set time, past a corona discharge unit 40, which serves to increase the force of electrostatic adhesion holding the toner particles on the copy paper 5, and then to a fixing unit 41 comprising a pair of pressure and heating rolls through which the copy paper 5 is passed and which serve to cause fusion of the toner particles and fixing thereof on the copy paper 5, and also forward the copy paper 5 to outlet tray, not shown.

After passing the transfer station, successive portions of the electrophotosensitive drum 6 are moved past an erase unit comprising an erase lamp 19 and corona discharge unit 20 which serve to remove from the drum 6 electrical charge by which remnant toner particles may still be held to the drum 6, and then past a cleaning unit 21 comprising a rotating sleeve 23 which serves to remove remnant toner from the drum 6 by magnetic attraction, a scraper element 22 which lightly contacts the drum 6 and removes toner particles, and a scraper 24 which removes toner particles from the rotating sleeve 23. Removed toner particles fall into receptacle 25. After passing the cleaning unit 21, drum 6 portions are brought into line with another erase lamp 26, which removes all charge therefrom, in order to permit even charging by the abovementioned charging lamp 14, for production of another photocopy.

Figure 5:
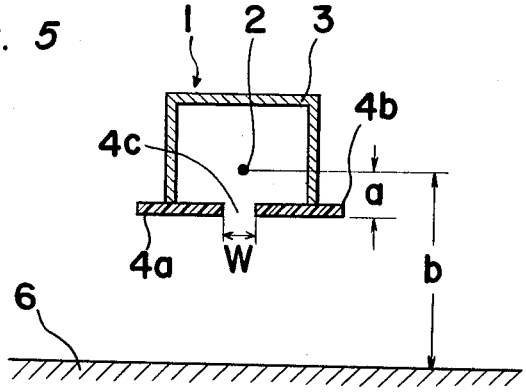
FIG. 5 is a cross-sectional view of transfer station means according to the invention.

Reference is now had to FIG. 5, which shows basic construction of a transfer station corona discharge unit according to the invention, which comprises shield elements 4*a* and 4*b* which are attached to the forward ends of opposite side walls of the shield 3 of the discharge unit 1, are disposed so that they are generally parallel to the line of advance of copy paper through the transfer station, and serve to define an opening 4*c* through which corona may be sprayed onto the copy paper 5. The width W of the opening 4*c* is less than the width W′ of the opening of a corona discharge unit for a transfer station in conventional equipment, and is such that the time for the copy paper 5 to be exposed by ionic current is insufficient to permit the discharge unit 1 to apply sufficient charge on the rear surface of the copy paper for charge to move from the rear to the forward side of the copy paper 5. If the time for which the copy paper is exposed is greater than the abovementioned time, toner particles on the copy paper could be attracted to the drum 6 and cause blow-off of toner particles.

Blow-off of toner particles can of course be effectively prevented by making the slit 4*c* extremely narrow, but it was found that completely satisfactory results in this respect were achieved by providing a slit 4*c* with a width of the order of 3 to 5 mm. On the other hand, with the opening 4*c* made narrower, there could obviously be problems of ensuring efficient spraying of copy paper 5 with corona charge to effect efficient transfer of toner particles.

Figure 1:
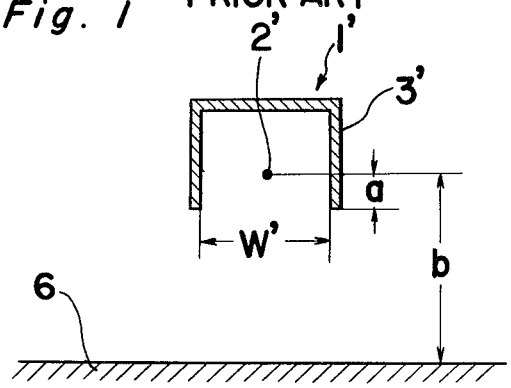
Fig. 1 PRIOR ART
Figure 2:
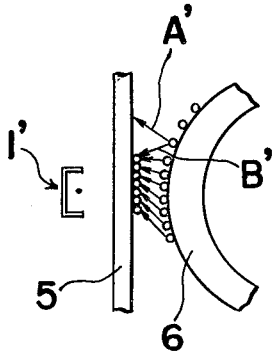
Fig. 2 PRIOR ART
FIG. 2 is an explanatory drawing illustrating problems associated with transfer of toner.
Figure 3:
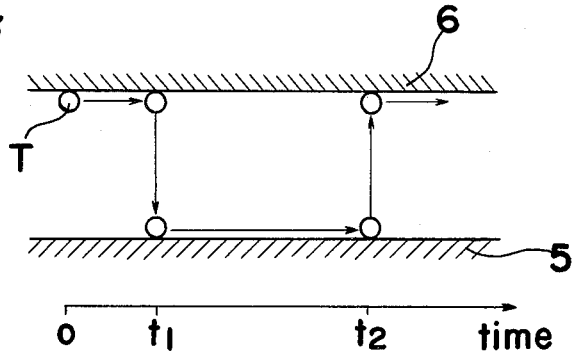
FIG. 3 is a similar drawing relating to use of conductive toner.

It was shown that there are such problems by tests conducted using a corona discharge unit such as shown in FIG. 1 which had an opening 25 mm wide, and corona discharge units having a construction according to the invention, such as shown in FIG. 5, and having slits of different widths W, test conditions in all cases being as follows.

| | |
|---|---|
| Toner resistivity | $10^3$ Ωcm |
| a | 5 mm |
| b | 15 mm |
| Applied voltage | 6 kV |
| Material of shield elements | Acryl |
| Latent image potential | 1,000 V |
| Density of original document | 1.0 |

Results of the test are shown in Table 2, from which it is seen that although small slit width is advantageous from the point of view of preventing blurring of photocopies, photocopy density becomes less as slit width is made smaller.

Table 2

| Slit width | Photocopy blurring | Photocopy density |
|---|---|---|
| 3 (mm) | None | 0.40 |
| 5 | Almost none | 0.80 |
| 10 | Present | 0.99 |
| 25 | Present | 1.02 |

The inventors therefore conducted a series of tests with the object of determining optimum conditions to permit the advantages of prevention of early toner particle transfer and blow-off while ensuring good quality of photocopies.

Figure 6A:
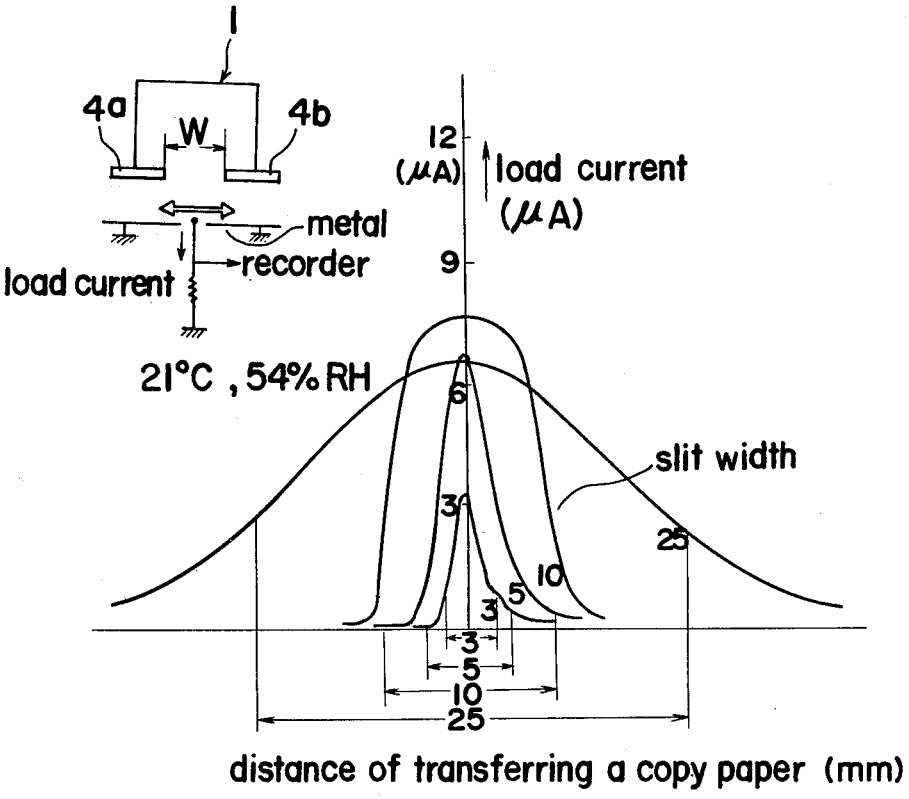
FIGS. 6A and 6B are graphs showing relation between width of the opening of a corona discharge unit and load current reaching copy paper at the transfer station for given charging voltages.

It was thought that variation of density of photocopies was probably influenced by variation of this load current. Therefore, in a first series of tests, whose results are plotted in FIG. 6A, the object was to determine the effect on useful load current, i.e., load current reaching copy paper 5, of varying slit width W when charging voltage is maintained constant, 6 kV in these tests. Slit width W was made 3 mm, 5 mm, 10 mm and 25 mm, and measurement was made with conventional metering device defining a circuit configuration shown to the left of the graph of FIG. 6A. It is seen from FIG. 6A that load current generally tends to decrease as slit width W is made smaller, this being presumably because the total amount of charge allowed to exit from the discharge unit becomes smaller.

Figure 6B:
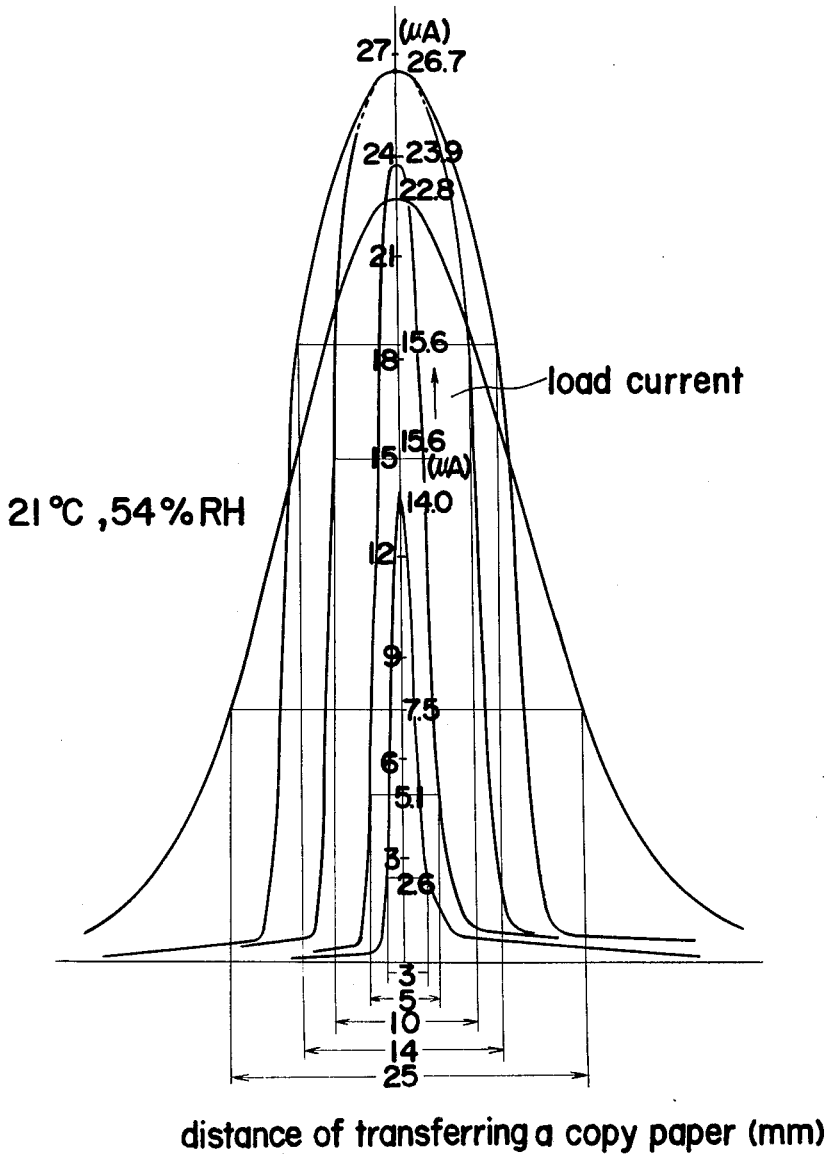

The same tendency was shown in another series of tests, whose results are plotted in FIG. 6B, and in which slit width was made 3 mm, 5 mm, 10 mm, 14 mm and 25 mm, while voltage applied on the corona discharge unit was 9 kV. It is seen, however, that increasing the value of voltage applied on the corona discharge unit results in higher values of load current for all values of slit width, the load current for a slit width of 3 mm in fact being higher than the highest value of load current achieved when applied voltage is 6 kV.

On the other hand, it is obviously desirable to keep necessary applied voltage as low as possible, and the object of further tests, therefore, was to determine what combinations of corona discharge unit and slit width give the most satisfactory photocopy results.

Figure 7:
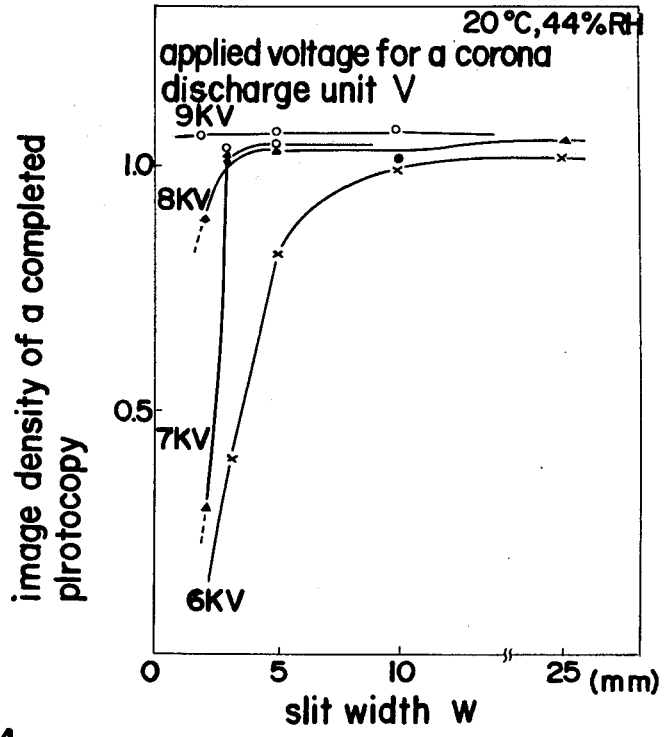
FIG. 7 is a graph showing relation between image density of a completed photocopy and width of the opening of corona discharge unit for different values of charging voltage.

First, there were conducted in which a completely black original document was employed, voltage applied on the corona discharge unit at the transfer station was made successively 6 kV, 7 kV, 8 kV, and 9 kV, and for image transfer at each of these voltages slit width was varied from 1 mm to over 25 mm. Other test conditions were as noted for the tests whose results are noted in Table 2 above. The density of photocopies obtained in these various conditions was then measured by a reflective densitometer the results of this measurement being plotted in FIG. 7, from which it is seen that for slit width W of over about 10 mm good density is achieved even if voltage applied on the corona discharge unit is as low as 6 kV, but that for values of applied voltage below 9 kV density decreases rapidly as slit width becomes very small, although good values of density are achieved even for values of applied voltage of 7 kV or 8 kV if slit width W is greater than about 3 mm. When applied voltage is 9 kV, density of the photocopy is more or less independent of slit width. In other words, slit width W can be made narrow enough to achieve efficient prevention of early transfer and blow-off of toner particles, and any reduction in photocopy density which might be caused by this narrowing of the slit 4*c* can easily be compensated by increasing value of voltage applied on the corona discharge unit 1.

In further tests, slit width was made 3 mm and 25 mm, an original document defining a 0.5 mm line picture was employed, and photocopies were produced to determine density achieved when voltage applied on the corona discharge unit was 6 kV and 9 kV. Other conditions were the same as in the tests described above, except that distance b between the corona wire 2 and the drum 6 was 13 mm. Measurements made when applied voltage was 6 kV are shown in FIG. 8A, and corresponding measurements when applied voltage was 9 kV are shown in FIG. 8B. In these drawings, the edge portion density was determined by means of a microreflection densitometer, and the flat portion indicates maximum density, assessed as the average of values obtained in the tests whose results are indicated in FIG. 6, and in which, in fact, distance from the corona wire 2 to the drum 6 was greater, at 15 mm. It is seen that there is suitable steepness of curve for both values of slit opening, both when applied voltage is 6 kV and when applied voltage is 9 kV, but that values of density achieved with a slit width of 3 mm are much lower than those achieved with a width of 25 mm when applied voltage is 6 kV. However, when applied voltage is 9 kV values of density are almost the same, regardless of slit width. In other words, for a line image it is also possible to compensate reduction of exposure time when opening 4c is narrow by increasing voltage applied on the corona discharge unit.

The density of the completed photocopy is also affected by distance of the corona wire 2 from the surface of the drum 6, as is clear from FIG. 9A, which plots results of tests in which slit width W was kept constant at 3 mm, voltage applied on the corona discharge unit 1 was made 6 kV, 7 kV, 8 kV and 9 kV and for each value of applied voltage distance of the wire 2 from the drum 6 was varied in the approximate range of from 7 mm to 13 mm. From the results shown in FIG. 9A it is again clear that, if applied voltage is 9 kV, varying the distance of the corona wire 2 from the drum 6 has virtually no effect on quality of completed photocopies. If applied voltage is 6 kV, there is rapid decrease of density with increasing distance of the wire 2 from the drum 6, but fairly good values of density are achieved for values of applied voltage of 7 kV and 8 kV if the distance between the wire 2 and the drum 6 is not increased beyond about 11 mm.

FIGS. 9B and 9C plot results of similar tests in which slit width was 5 mm and 10 mm, respectively, and applied voltage was 5 kV, 6 kV, 7 kV and 8 kV.

In FIG. 9B, it is seen that for a slit width of 5 mm, when the value of the applied voltage is 6 kV or higher, the density is generally satisfactory regardless of distance b, but that there is considerable dependence of density on distance b if the applied voltage is 5 kV.

Similar results are achieved when slit width is 10 mm, as indicated in FIG. 9C. However, when slit width is 10 mm, although suitable values of density in photocopies are easily achieved, it was found that blurring such as noted in Table 2 occurred.

In consideration of the abovedescribed test results, to achieve good values of density and definition in photocopies, slit width W is made 3 to 5 mm, and compensation for reduction of exposure time resulting from use of a narrow opening for corona discharge is made by suitably increasing voltage applied on the corona discharge unit at a transfer station and/or decreasing the distance between the corona discharge wire and electrophotosensitive medium.

With the means of the invention, if the shield elements 4 are made of dielectric material and are maintained insulated with respect to ground potential, or have imposed thereon a bias potential of the same polarity as the corona discharge, extremely good control of the discharge region is achieved. This may be appreciated by consideration of the fact that if the shield elements 4 are held at ground potential or at a bias potential of a polarity opposite to that of the corona discharge, corona discharge becomes largely absorbed by the shield elements 4, and effective charging of copy paper becomes difficult.

Thus, according to the invention the width of the opening of a corona discharge unit at a transfer station is made narrower, and compensation to ensure requisite values of density in completed photocopies is easily effected by increasing voltage applied on the corona discharger unit and/or decreasing the distance between the corona discharge wire and an electrophotosensitive medium from which a toner image is to be transferred, while at the same time problems of early transfer and blow-off of toner particles are resolved.

Needless to say, the invention is not limited to use in a photocopying machine having the precise construction shown and described in reference to FIG. 4, but may be easily adapted to constitute photocopying machines using conductive toner but having other constructions. Also, the same advantages are achieved if the slit 4c is not defined by shield elements actually attached to the discharge unit 1 but by independently supported shield elements provided between the corona discharge unit 1 and drum 6.

Although the present invention has been fully described by way of example with reference to the attached drawings, it should be noted that various changes and modifications are apparent to those skilled in the art. Therefore, unless otherwise such changes and modifications depart from the scope of the present invention, they should be construed as included therein.

What is claimed is:

1. In a photocopying apparatus wherein a latent image of an original document to be copied is formed on an electrophotosensitive medium, electrically conductive toner particles are applied to said medium to develop said image, and said developed image is transferred onto copy paper by bringing said copy paper into effective contact with said electrophotosensitive medium and applying an ionic current from a corona discharge unit to the rear surface of said copy paper to cause said toner particles to move onto said copy paper, the improvement comprising shield elements which are provided between said electrophotosensitive medium and said discharge unit, and defining a slit for passing the corona discharge and having a width and said corona discharge unit being spaced from said electrophotosensitive medium and the speed of movement of the copy paper past the corona charger and the voltage applied to the corona charger being such that the amount of said current applied to said copy paper is sufficient to cause transfer of toner particles onto said copy paper but insufficient to permit storage in said copy paper of a charge great enough to cancel the charge of said toner particles transferred onto said copy paper.

2. The improvement as claimed in claim 1, wherein the width of said slit is in the range of from 3 to 5 millimeters.

3. The improvement as claimed in claim 1, wherein said shield elements are made of dielectric material.

4. The improvement as claimed in claim 1, wherein said toner employed is a conductive toner having a resistivity in the range of from $10^3$ to $10^7$ Ωcm when subjected to a compressive pressure of 100 kg/cm$^3$.

5. In photocopying apparatus wherein a latent image of an original document to be copied is formed on a electrophotosensitive medium, electrically conductive toner particles having a resistivity in the range of from $10^3$ to $10^7$ Ωcm when subjected to a compressive pressure of 100 kg/cm$^2$ are applied on said medium to develop said image, and said developed image is transferred onto copy paper by bringing said copy paper into effective contact with said electrophotosensitive medium and applying an ionic current from a corona discharge unit to the rear surface of said copy paper to cause said toner particles to move onto said copy paper, the improvement comprising shield elements which are provided between said electrophotosensitive medium and said discharge unit, and defining a slit for passing the corona discharge and having a width of 3 to 5 millimeters, and said corona discharge unit being spaced from said electrophotosensitive medium and the speed of movement of the copy paper past the corona discharge unit being such that when a voltage of more than 8 kV is applied to said corona discharge unit the current applied to the copy paper is sufficient to cause transfer of toner particles onto said copy paper but insufficient to permit storage in said copy paper of a charge great enough to cancel the charge of said toner particles transferred onto said copy paper.

6. Photocopying apparatus as claimed in claim 5, wherein said shield elements are made of dielectric material.

7. In a photocopying apparatus wherein a latent image of an original document to be copied is formed on an electrophotosensitive medium, electrically conductive toner particles having a resistivity in the range of from $10^3$ to $10^7$ Ωcm when subjected to a compressive pressure of 100 kg/cm$^2$ are applied on said medium to develop said image, and said developed image is transferred onto copy paper by bringing said copy paper into effective contact with said electrophotosensitive medium and applying an ionic current from a corona discharge unit having a corona wire to the rear surface of said copy paper to cause said toner particles to move onto said copy paper the improvement comprising shield elements which are provided between said electrophotosensitive medium and said discharge unit, and defining a slit for passing the corona discharge and having a width of 3 to 5 millimeters, and the corona wire is spaced 8 millimeters from said electrophotosensitive medium, and the speed of movement of the copy paper past the corona discharge unit being such that when a voltage of approximately 6 kV is applied to the corona wire of said corona discharge unit, the current applied to the copy paper is sufficient to cause transfer of toner particles onto said copy paper but insufficient to permit storage in said copy paper of a charge great enough to cancel the charge of said toner particles transferred onto said copy paper.

8. Photocopying apparatus as claimed in claim 7, wherein said shield elements are made of dielectric material.

* * * * *